US005547563A

United States Patent [19]

Stowe

[11] Patent Number: 5,547,563

[45] Date of Patent: Aug. 20, 1996

[54] METHOD OF CONVERSION OF HEAVY HYDROCARBON FEEDSTOCKS

[76] Inventor: Lawrence R. Stowe, 2313 Dartmouth Dr., Arlington, Tex. 76015

[21] Appl. No.: 393,201

[22] Filed: Feb. 23, 1995

Related U.S. Application Data

[63] Continuation-in-part of Ser. No. 136,531, Oct. 14, 1993, abandoned.

[51] Int. Cl.[6] ..... C01G 9/00; C01G 11/00

[52] U.S. Cl. ..... 208/106; 208/113

[58] Field of Search ..... 208/106, 113

[56] References Cited

U.S. PATENT DOCUMENTS

| | | | |
|---|---|---|---|
| 2,657,985 | 11/1953 | Schutze et al. | 585/16 |
| 2,800,444 | 7/1957 | Hughes et al. | 204/157.62 |
| 3,268,432 | 8/1966 | Nance | 204/157.62 |
| 3,305,480 | 2/1967 | Mills | 208/273 |
| 3,497,005 | 2/1970 | Pelopsky et al. | 166/247 |
| 3,616,375 | 10/1971 | Inoue | 204/157.61 |
| 3,630,866 | 12/1971 | Pelofsky | 204/157.62 |
| 3,819,740 | 6/1974 | Hori | 585/539 |
| 4,303,494 | 12/1981 | Whitehurst et al. | 201/3 |
| 4,306,982 | 12/1981 | Bloom | 507/202 |
| 4,391,608 | 7/1983 | Dondelewski | 44/624 |
| 4,643,820 | 2/1987 | Zarrineghbal et al. | 208/222 |
| 4,992,614 | 2/1991 | Rodewald | 585/722 |

OTHER PUBLICATIONS

Steensma, Rene, "Application of Ultrasonics in the Extraction of Gold and Silver Ores," 88 *Randol Gold Forum,* pp. 179–186 (No Date).

Clark, A. E. "Magnetostrictive Rare Earth–$Fe_2$ Compounds, "vol. 1, *Ferromagnetic Materials,* North–Holland Publishing Company (1980), pp. 531–588 (No Month).

Verhoeven, J. D. et al., "The Growth of Single Crystal Terfenol–D Crystal," vol. 18A, *Metallurgical Transactions A,* (1987), pp. 223–231 (Feb.).

*Primary Examiner*—Glenn Caldarola
*Assistant Examiner*—Water D. Griffin
*Attorney, Agent, or Firm*—Pravel, Hewitt, Kimball & Krieger

[57] ABSTRACT

A method of conversion of a heavy hydrocarbon feed to a lighter hydrocarbon product. The method provides for adding to the heavy hydrocarbon feed a terpene, preferably d-limonene, an aromatic solvent, an aliphatic solvent, and a liquid catalyst including a free chloride ion source, a free nitrate ion source, and an anionic hydrophile, all dissolved in a polar solvent, and the contacting of the heavy hydrocarbon feed with sonic vibrations.

30 Claims, 3 Drawing Sheets

METHOD OF CONVERSION OF HEAVY HYDROCARBON FEEDSTOCKS

CROSS-REFERENCE TO RELATED APPLICATION

This application is a continuation-in-part of U.S. application Ser. No. 08/136,531, filed Oct. 14, 1993, now abandoned for METHOD OF CONVERSION OF HEAVY HYDROCARBON FEEDSTOCKS.

BACKGROUND OF THE INVENTION

1. Field of the Invention

This invention relates to a method of conversion of heavy hydrocarbon feeds to lighter hydrocarbon products. More particularly, this method provides for the addition of a terpene or a mixture of terpenes and fatty acid esters plus pine oil and a liquid catalyst, and the contacting of the heavy hydrocarbon feed with sonic vibrations, which convert the heavy hydrocarbon feed to a lighter hydrocarbon product.

2. Description of the Related Art

In the processing of crude oil and heavy crude oil fractions, it is often desirable to convert a heavy, viscous material to lighter, less viscous products to increase the usefulness and value of the products. The methods of converting heavy, viscous materials to lighter, less viscous products are generally known as "conversion" or "cracking" processes. These processes entail the breaking of hydrocarbon bonds in the generally larger molecules of the heavy crude oil to produce smaller, lighter molecules. There are many known conversion or cracking processes, including coking, fluid catalytic cracking (FCC), and hydrotreating. These known and commonly used conversion processes suffer from the disadvantages of high facilities cost and high operating cost, as they usually operate at high temperature and/or high pressure.

The use of sonic and/or ultrasonic vibrations for the cracking of hydrocarbon bonds is also known. For example, U.S. Pat. No. 3,497,005 to Pelopsky discloses the use of sonic energy for the cracking of petroleum crude oil. Also, U.S. Pat. No. 3,616,375 to Inoue discloses the use of sonic or ultrasonic vibrations for treating crude oil to remove sulfur.

There exists a need for a method of converting heavy hydrocarbon feeds to lighter hydrocarbon products which operates at relatively low temperatures and low pressures, which requires minimal capital investment in equipment, and which operates with low cost.

SUMMARY OF THE INVENTION

It is an object of this invention to convert low value, heavy hydrocarbon feeds to higher value, lighter hydrocarbon products via a process which operates at relatively low temperatures and low pressures, which requires minimal capital investment in equipment, and which operates with low cost.

The invention relates to a process for the conversion of heavy hydrocarbon feeds to lighter hydrocarbon products to convert high viscosity, low value feedstocks to low viscosity, higher value products. The process of the present invention includes the addition of a terpene, preferably d-limonene or a mixture of terpenes and fatty acid esters plus pine oil, addition of a liquid catalyst, and the contacting of the heavy hydrocarbon feed with sonic vibrations. The process of the present invention converts heavy, high viscosity feeds including heavy crudes, residuals or "resids," various bottom streams and/or tank/tanker residual bottoms into lighter, more valuable products which contain a high percentage of distillate cuts such as naphtha, kerosene, and gas oil.

DETAILED DESCRIPTION OF EXEMPLARY EMBODIMENTS

Figure 1:
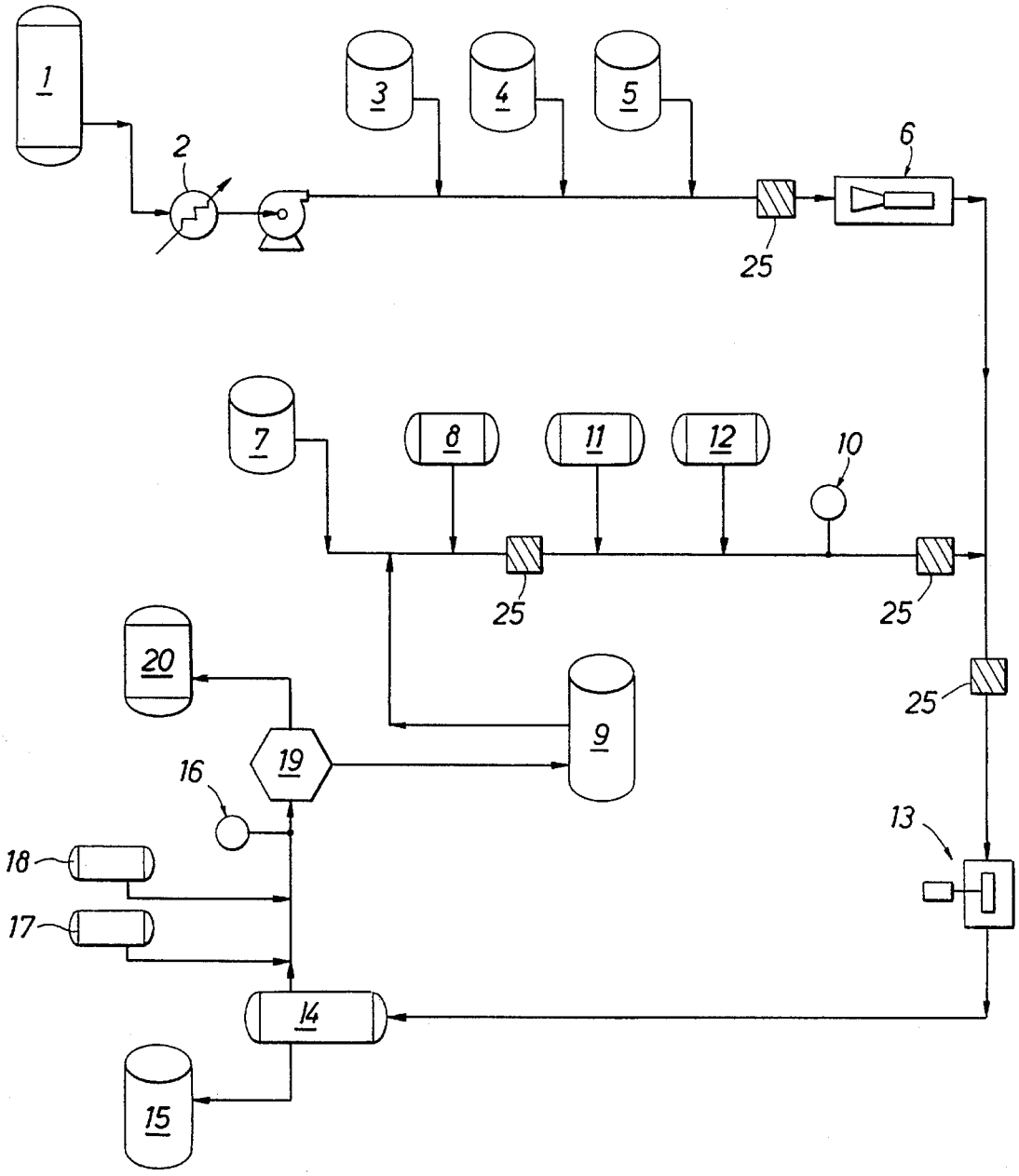
FIG. 1 is a simplified process flow diagram showing the overall process of the present invention.

FIG. 1 shows a simplified process flow diagram of the process of the present invention, which includes both the preferred processing steps and optional, optimizing processing steps. A heavy hydrocarbon feed 1 may be heated in a heat exchanger 2 or otherwise so as to facilitate pumping through the processing equipment. An aliphatic solvent 3, an aromatic solvent 4, and a terpene 5 are added to the heavy hydrocarbon feed 1. The combination of the heavy hydrocarbon feed 1, the aliphatic solvent 3, the aromatic solvent 4, and the terpene 5 are contacted with sonic frequencies in a sonic reactor 6. To this combination is added a liquid catalyst 7, an ammonia ion source 8, and a brine solution 9. The pH of these three components 7–9 is controlled to a predetermined pH via pH meter 10 and acid 11 or base 12 addition. The combination of the hydrocarbon feed and all the above additions is passed through a sonic de-emulsifier 13 and an oil/water separator 14 which separate a lighter hydrocarbon product 15 and an aqueous phase. The aqueous phase is routed to pH meter 16 which controls the pH to a predetermined pH by the addition of acid 17 or base 18 to aid in the removal of solid particles in a solids separator 19. The solids are removed to a solids disposition 20 and the aqueous phase is recycled to the brine tank 9.

As used herein, "conversion process" relates to a process for breaking hydrocarbon bonds of a heavy hydrocarbon feed into a lighter hydrocarbon product, which is commonly referred to as "cracking".

As used herein, "heavy hydrocarbon feed" refers to the feed to the present process. The "heavy hydrocarbon feed" is typically a heavy crude, resid, various bottom streams, tank/tanker residual bottoms, or mixtures thereof. Also, "heavy hydrocarbon feed" may refer to other feedstock which do not require a high conversion, but rather it is desired to remove undesirable contaminants such as sulfur and metals.

As used herein, "lighter hydrocarbon product" refers to the product from the present conversion process. The "lighter hydrocarbon product" comprises molecules of a generally lower molecular weight than the molecules in the heavy hydrocarbon feed. Generally, the "lighter hydrocarbon product" will contain molecules boiling off in the naphtha, kerosene, and gas oil ranges as well as unconverted heavy hydrocarbon feed. Generally, the "lighter hydrocarbon product" has lower boiling fractions, a lower density and a lower kinematic viscosity than the heavy hydrocarbon feed. Also, "lighter hydrocarbon product" refers to the product of the present conversion process where a high conversion is not desired, but where significant amounts of contaminants such as sulfur and metals are removed.

Unexpectedly, the addition of d-limonene or a mixture of terpenes and fatty acid esters plus pine oil was found to effectuate the conversion of a heavy hydrocarbon feed to lighter hydrocarbon products in the combinations of steps described. The addition of d-limonene or a mixture of terpenes and fatty acid esters plus pine oil to a heavy hydrocarbon feed was found to lower the viscosity and density much more than expected due to viscosity blending and density blending effects. The fact that a conversion reaction occurs upon the addition of d-limonene is supported by simulated distillation testing and analysis. As shown in Examples I, II, and III, the addition of d-limonene causes a significant and unexpected increase in the amount of lighter boiling fractions, even after accounting for the boiling off of the d-limonene and solvents added. d-Limonene is an acetic mineral oil, a terpene compound, which is obtained by the high pressure extraction from orange peels. It is believed that other terpenes may be suitable substitutes for d-limonene, including dipentene, pine oil, tall oil fatty acids, orange terpene and citrus terpene. Example IV demonstrates the beneficial effect of some of these compounds. While the mechanism via which d-limonene or other terpenes effectuate hydrocarbon conversion is not known, it is theorized that terpenes:

1) cleave the molecular bonds holding long chain aliphatic molecules together, and
2) detach side chain aliphatic compounds from the aromatic and cyclic ring structures found in crude oils.

The net result is to increase the shorter chain aliphatic compounds typically found in the kerosene and naphtha fractions of hydrocarbon mixtures. The gas-oil fraction is enhanced when long chain aliphatic molecules are removed from the resid fraction.

It is believed that terpenes are more likely to attack the non-volatile liquid components of resids than the non-volatile solid components of resids. Therefore, not all feedstocks will respond equally well to the treatment. However, the conversion process should lead to an improved product in almost all cases. Molecular changes are known to have beneficial effects on the pour point and viscosity of liquid hydrocarbons. A heavy feedstock becomes less dense and lighter when chain lengths are shortened. These effects are also observed in Examples I, II and III.

The present process is improved via the use of the liquid catalyst 7. The liquid catalyst 7 is an ionic solution which serves to remove contaminants such as sulfur and metals so as to aid in the conversion process. The liquid catalyst 7 includes a free chloride ion source, a free nitrate ion source, an anionic hydrophile, and optionally a non-ionic hydrophile, all dissolved in a polar solvent. Due to availability and low cost, it is preferred to use water as a polar solvent. However, other solvents may be used as long as the chloride ion source and the nitrate ion source are soluble therein.

The chloride ion source may be any chloride compound suitable for providing a free chloride ion in the polar solvent. Examples include ammonium chloride, hydrogen chloride, lithium chloride, potassium chloride, and sodium chloride. The liquid catalyst should contain from about 0.01 to 10, preferably 0.25 to 1 moles of chloride ion per liter.

The nitrate ion source may be any nitrate compound suitable for providing a free nitrate ion in the polar solvent, such as ammonium nitrate, nitric acid, lithium nitrate, potassium nitrate and sodium nitrate. The liquid catalyst should contain from about 0.01 to 10, preferably 0.25 to 1 moles of nitrate ions per liter. The relative amounts of the chloride ions and nitrate ions should be such that the mole ratio of chloride ions to nitrate ions is in the range from 1 to 1½.

The anionic hydrophile may be virtually any such hydrophile, so long as the hydrophile is soluble in the polar solvent. Any of the following types may be used: soaps, sulfated soaps, sulfated amides, sulfated alcohols, sulfated ethers, sulfated carboxylic acids petroleum sulfonates, sulfonated aromatic hydrocarbons, sulfonated aliphatic hydrocarbons, sulfonated aromatic aliphatic hydrocarbons, sulfonated amides, sulfonated ethers, acylated amino acids, acylated polypeptides and metal alkyl phosphates. Representative examples include sodium dodecylatedoxydibenzene disulfonate, sodium lauryl sulphate, sodium N-alkylcarboxy sulfosuccinate, sodium alkylsulfosuccinate, polyaikanolamine fatty acid condensate, sodium alkylbiphenyl sulfonate, sodium alkyl-naphthalene sulfonate and sodium dodecylbenzene sulfonate. The concentration of anionic hydrophile in the catalyst system should be at least about $1\times10^{-4}$ moles per liter and preferably $1\times10^{-3}$ moles per liter.

The non-ionic hydrophile is soluble in the polar solvent. Examples of suitable non-ionic hydrophiles include esters of polyhydric alcohols, alkoxylated amides, esters of polyoxyalkylene glycols, ethers of polyoxyethylene glycols, alkylolamide-fatty acid condensates, tertiary acetylenic glycols and dialkylpolyoxyalkylene phosphates. It is preferred to employ a non-ionic ethanol hydrophile having a molecular weight from about 78 to about 250 or higher. Other specific examples include alkyl aryl polyoxyethylene ether and polyoxyethylene alkyl triether.

The heavy hydrocarbon feed 1 generally contains asphaltene molecules and/or high molecular weight aliphatic or paraffinic molecules. The heavy hydrocarbon feed 1 may be a solid material or the viscosity may be so high that it is essentially non-flowable at ambient temperature. In order to effectuate the processing steps, the viscosity should be lowered. It is preferable to lower the viscosity by adding solvents and/or heating the heavy hydrocarbon feed. Preferably, an aliphatic solvent 3 and an aromatic solvent 4 would be used, the aliphatic solvent 3 serving to dissolve, i.e., reduce the viscosity of, the aliphatic/paraffinic type molecules, and the aromatic solvent 4 aiding in dissolving, i.e., reducing the viscosity of, the asphaltene type molecules. The aliphatic solvents 3 which may be used include pentane, hexane, cyclohexane, heptane, VM&P naphtha (light naphtha), and most preferably kerosene. The aromatic solvents 4 which may be used include toluene, ethylbenzene, heavy atmospheric naphtha (H.A.N.) or preferably, xylene. Also, high viscosity heavy hydrocarbon feed may be heated to lower the viscosity such that the feed may flow through the various processing steps. The heating temperature will vary depending upon feedstock, but will generally be in the range of 120° to 200° F.

The process of the present invention is further improved by contacting the combination of the heavy hydrocarbon feed 1, the d-limonene 5, the aromatic solvent 4, and the aliphatic solvent 3 with sonic vibrations in a sonic reactor 6. It is believed the sonic vibrations serve two functions. First, it is believed that the sonic vibrations mixes the heavy hydrocarbon feed, d-limonene and solvents, providing a very intimate contacting. Second, it is believed that the sonic vibrations cause molecular vibrations and cavitation with a resulting high pressure and high temperature at the molecular level due to the collapse of the bubbles which breaks hydrocarbon bonds, especially in combination with d-limonene as described above.

While sonic vibrations in the sonic reactor 6 may be provided in a variety of ways, such as the use of "piezo-electro crystals", it is preferred to use a sonic transducer with a terfenol rod. The piezo-electro crystals are generally not preferred as they generally provide higher frequency, i.e., ultrasound vibrations, and tend to transmit only a single frequency or a very narrow range of frequencies. A sonic transducer utilizing a terfenol rod is preferred as it provides a variable, i.e., chaotic frequency in a broader band. Terfenol is an alloy composed of 90% iron (Fe), 5% dysprosium (Dy), and 5% terbium (Tb), which when excited by electricity drives a transducer to produce sonic vibrations or waves.

Figure 2:
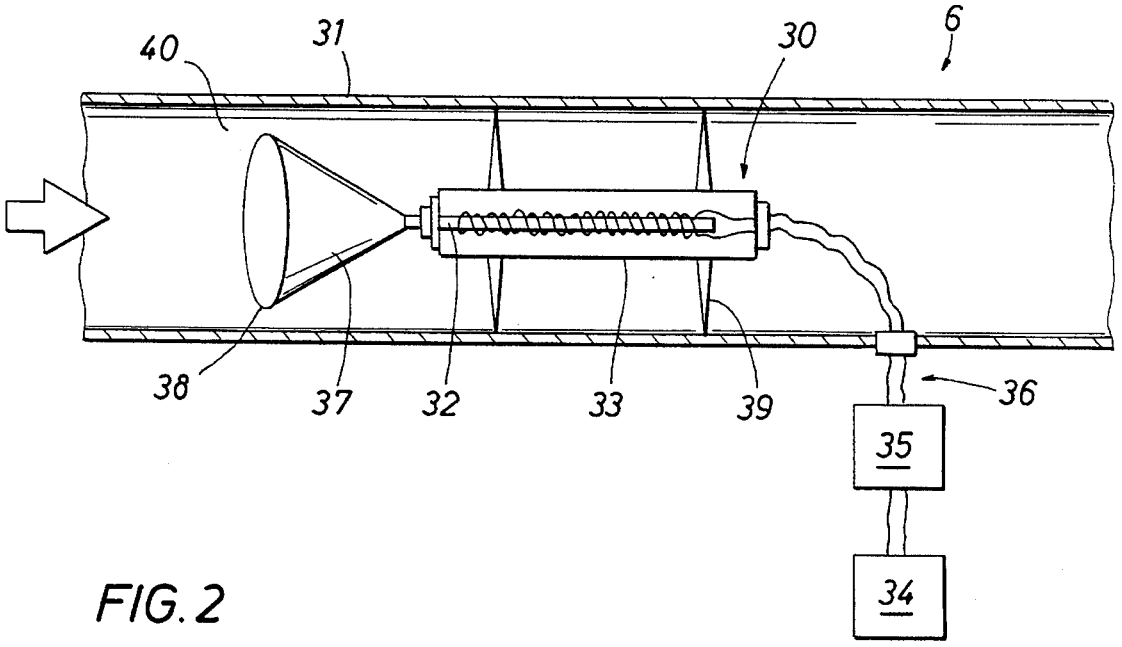
FIG. 2 is a simplified drawing showing an embodiment of the sonic reactor.

While the combination of the heavy hydrocarbon feed, the d-limonene and the solvents may be contacted with sonic vibrations in a variety of ways, the preferred method and apparatus for providing the sonic vibrations is shown in FIG. 2. FIG. 2 shows the preferred sonic reactor 6 which includes a sonic transducer 30 mounted within a sonic reactor vessel 31. The sonic transducer 30 includes a terfenol rod 32 enclosed within a transducer casing 33.

Power supply to the transducer 30 is supplied through a signal generator 34 and an amplifier 35 through two wires 36 which lead to and are coiled about the terfenol rod 32. The signal generator 34 provides a variable frequency, i.e., chaotic frequency signal which when amplified by the amplifier 35 causes the terfenol rod 32 to vibrate with nearly identical frequencies as that produced by the signal generator 34. Generally, the signal generator 34 has a low power output, about 1 Watt or less, with the amplifier 35 increasing the power output to about 30–90 W. The sonic vibrations of the terfenol rod 32 are transmitted to a cone-shaped horn 37, which in turn vibrates at the same frequency as a terfenol rod 32. A distal end 38 of the horn 37 is located in close proximity to the inside surface of the sonic reactor vessel 31.

The sonic reactor vessel 31 is generally a pipe-shaped vessel in which the sonic transducer 30 is located. The sonic transducer 30 is secured within the sonic reactor vessel 31 via centralizers 39 which serve to hold or stabilize the transducer 30 within the sonic reactor vessel 31.

In use, the heavy hydrocarbon feed, d-limonene and solvents enter the sonic reactor vessel 31 from the left as shown in FIG. 2, and flow through an annular space 40 between the distal end 38 of the cone-shaped horn 37 and the inside surface of the sonic reactor vessel 31 and flow past the sonic transducer 30. As the heavy hydrocarbon feed, d-limonene and solvents flow through this annular space 40, they are contacted by sonic vibrations emitted from the cone-shaped horn 37. As described below, the annular space 40, i.e., the distance between the distal end 38 of the horn 37 and the inside surface of the sonic reactor vessel 31, should be designed such that the majority of the heavy hydrocarbon feed, d-limonene and solvents passing through the annular space is contacted by sonic vibrations emitted from the horn 37. Generally the distance between the distal end 38 of the horn 37 and the inside surface of the sonic reactor is no larger than ¾ inch, however, the distance will vary based upon the power input to the transducer, physical properties of the heavy hydrocarbon feed, d-limonene and solvents, etc.

The process of the present invention may use any sonic frequencies, i.e. any frequencies in the audible range, 1 Hz to 20 kHz, with 1,000–2,000 Hz preferred and 1,200–1,800 Hz most preferred. The optimum frequency is about 1430 Hz. It is preferable to use variable frequency, i.e., chaotic frequency, varying within a band of approximately 50 Hz wherever the amperage output is at maximum. As these audible frequencies may be annoying or distracting to persons in the area, it is preferable to provide sound insulation.

As noted above, the design of the sonic reactor vessel 31, cone-shaped horn 37 and power input to the sonic transducer 30 should be designed together to ensure that the sonic waves emitted from the cone-shaped horn 37 propagate in a radial direction so as to contact essentially all the heavy hydrocarbon feed, d-limonene and solvent passing through the annular space 40. It has been found that to process a flow rate of 4200 barrels per day, a ½ inch diameter terfenol rod mounted within a 1½ inch casing 33, and located within a 3 inch ID sonic reactor vessel 31, with an annular space 40 of ¾ inch and with a power input of 30–90 W yields suitable results.

Generally, at lower frequencies, sonic vibrations or waves will propagate further through a fluid. Thus, the annular space 40 may be greater when lower frequencies are employed. Power input to the transducer 30/horn 37 may be increased by increasing wattage from the amplifier 35, providing a larger diameter terfenol rod 32, or by stacking rods. Also, the cone-shaped horn 37 may be extended in an axial direction to provide a greater residence time between the cone-shaped horn 37 and the inside surface of the sonic reactor vessel 31 such that the fluid flowing through the annular space 40 will be contacted by sonic waves for a longer time period. Further, several sonic reactors 6 could be provided in series to ensure that all of the heavy hydrocarbon feed, d-limonene, and solvents are contacted by sonic vibrations.

The preferred sonic transducer 30, sonic reactor vessel 31, horn 37, signal generator 34 and amplifier 35 may be purchased from Sonic Research Corp. of Moline, Ill.

Referring to FIG. 1, the heavy hydrocarbon feed 1 is pumped from a tank or other source through the processing steps. Generally, the pumps should supply a pressure of approximately 250 psig so as to move the heavy hydrocarbon feed 1 through the various processing steps. To the heavy hydrocarbon feed is added generally 1–5 vol. %, preferably 2–3 vol. % of the aromatic solvent 3 and generally, 1–15 vol. %, preferably 1–5 vol. % of the aliphatic solvent 4. The presence of or quantity of the aromatic and aliphatic solvents are not critical and the solvents should be added with consideration to the heating step (heat exchanger 2) to provide a readily flowable combination which will allow flow through the various processing steps, including static mixers.

The terpene 5, which is preferably d-limonene, is generally more expensive than the solvents and the addition rate should be more strictly controlled. The d-limonene addition rate depends upon the viscosity of the heavy hydrocarbon feed stream and the economics of the upgrade of the heavy hydrocarbon feed to lighter hydrocarbon product. Generally, d-limonene is added in an amount of 0.5–50 vol. %, preferably 0.5–10 vol. %, and most preferably 0.5–6 vol. %. The combination of the heavy hydrocarbon feed, aromatic solvent, aliphatic solvent and d-limonene are contacted with sonic vibrations in the sonic reactor 6, as discussed above.

Liquid catalyst 7, as described above, in combination with a brine solution 9 and an ammonium ion source 8, which are adjusted to a pH of about 7.5 by the addition of acid 11 or base 12 are added to the heavy hydrocarbon feed, d-limonene and solvents exiting the sonic reactor 6.

Preferably about 0.1–10 parts of liquid catalyst 7 are added per 1,000 parts brine solution 9. Most preferably, 1 part catalyst is added per 1,000 parts brine solution 9.

Preferably, 25–100 vol. % brine/liquid catalyst solution is added to the heavy hydrocarbon feed, d-limonene, and solvent mixture. Most preferably, about 50 vol. % brine/liquid catalyst solution is added to the heavy hydrocarbon feed, d-limonene, and solvent mixture. Both the dilution and volume of the catalyst mixture depends on the amount of metals to be removed. A metals scan prior to running the process may be used to set the appropriate range. The brine/liquid catalyst solution is thoroughly mixed with the heavy hydrocarbon feed, d-limonene and solvent mixture and serves to remove metals and sulfur from the heavy hydrocarbon feed, d-limonene, and solvent mixture and otherwise aid in the conversion process.

It is believed that the ammonia ion sources 8, which is preferably ammonia gas or ammonium hydroxide, provides hydrogen to saturate hydrocarbon bonds, particularly at bond breakage sites. The ammonium hydroxide, when used, is added in the range of 0.1–10 vol. %, preferably 0.1–5 vol. %, and most preferably 0.1–2 vol. %.

After mixing as above, it is desirable to separate the brine/liquid catalyst solution, i.e., aqueous phase, from the hydrocarbon phase which includes the converted heavy hydrocarbon feed, the d-limonene, and the solvents. A sonic de-emulsifier 13, as described below, may be used to aid in the separation of the aqueous phase and the hydrocarbon phase. An oil/water separator 14, of any known design, is used to effectuate separation of the aqueous phase and the hydrocarbon phase.

The aqueous phase is adjusted to a pH of approximately 5–6 by the addition of acid 17 or base 18 to facilitate the removal of metals and other contaminants as solid particles. The removal of the solid particles occurs in a solids separator 19 which may be a centrifuge, filter, or other device which may be used for the separation of precipitated metals from an aqueous phase. The solids are transferred to a solids disposition 20 and the aqueous phase may be recycled back to the brine 9 storage tank. An alternate procedure would be to dispose of the aqueous phase down an injection well.

The separated hydrocarbon phase is the "lighter hydrocarbon product" 15. The composition of lighter hydrocarbon product 15 depends upon the composition of the heavy hydrocarbon feed 1, the amount of d-limonene added, the amount of solvents added, the amount and activity of the liquid catalyst 7, and the operation of the sonic reactor 6. The present process converts asphaltene and other high molecular weight molecules to molecules boiling off in the naphtha, kerosene, and/or gas oil ranges. Generally, it is preferred to convert 30% or more of the heavy hydrocarbon feed 1 to naphtha and lighter boiling fractions. The present process may also be used in the situation where a high conversion is not required, rather it is desirable to remove a significant amount of the contaminants including sulfur and metals. Thus, the process has economic value in significantly improving the market value of low quality feedstocks.

Figure 3:
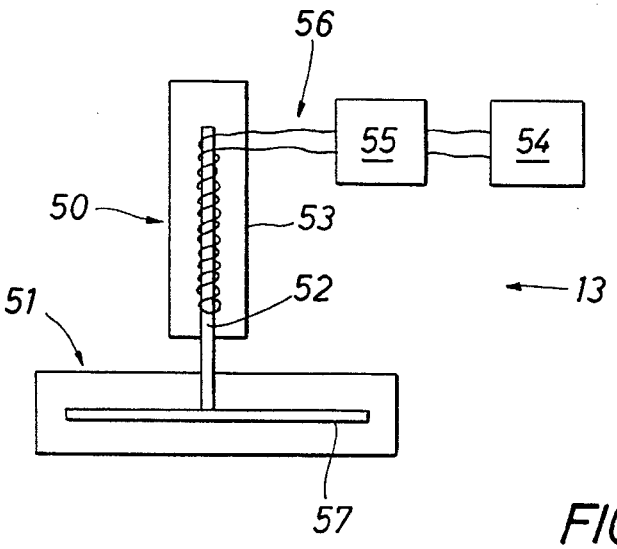
FIG. 3 is a simplified drawing showing an embodiment of the sonic de-emulsifier.

FIG. 3 shows the preferred embodiment of the sonic de-emulsifier 13. The de-emulsifier 13 is composed of two components, a sonic transducer 50 and a de-emulsifier vessel 51. The sonic transducer 50 is similar in design and operation to the sonic transducer 30 used in the sonic reactor 6. However, the terfenol rod 52 is connected to a rectangular plate 57 which is placed generally in the middle of the de-emulsifier vessel 51 in close proximity to the walls of the de-emulsifier vessel 51. As shown in FIG. 3, the fluid flows either into the page or out of the page. The distance between the rectangular plate 57 and the walls of the de-emulsifier vessel 51 are such that sonic vibrations may contact the majority of aqueous phase and hydrocarbon phase flowing through the de-emulsifier 13. The sonic de-emulsifier 13 has a signal generator 54, amplifier 55 and wires 56 coiled about the terfenol rod 52, and generally operates in a similar fashion, but at a different frequency than the sonic transducer 30 used in the sonic reactor 6.

The fluid should have a relatively short residence time in the de-emulsifier vessel 51. It has been found that a long residence time causes the re-formation of an emulsion. It has been determined that a de-emulsifier vessel 1 inch high, 7 inches wide, and 8 inches in depth, with a ⅜ inch space above and below the rectangular plate 57 is suitable for de-emulsifying 4200 barrels per day. The preferred manufacturer of the sonic de-emulsifier 13 is Sonic Research Corp. of Moline, Ill.

The preferred de-emulsifying frequency varies with the heavy hydrocarbon feed, amount of brine/liquid catalyst added, and other factors. Generally, the de-emulsifying frequency is determined by trial and error, but generally is in the range of 1–1,500 Hz, preferably 5–1,200 Hz, most preferably 800–1,000 Hz, optimally 900 Hz. The power input to the sonic transducer 50 is generally 30–90 W.

As shown in FIG. 1, a number of static mixers 25, of any known design, should be provided throughout the process to provide for intimate mixing of the components.

Example I

A sample believed to be refinery vacuum tower bottoms from a Venezuelan crude oil was obtained. At ambient temperature, the sample appeared as a hard, coal-like substance. The sample was analyzed and produced the results shown in column IA, below. The sample was chipped from its container, and the chips were collected and placed in a melting pot over a burner, with water added to ensure that the boiling point would not exceed 212° F., so as to permit handling of the pot. A melting process lasted approximately 30 minutes.

After melting, the substance appeared as a thick pitch, tar-like material containing golf and tennis ball size semi-solid lumps. This material was poured into a jar and 5 vol % kerosene, 5 vol % xylene, and 3 vol. % d-limonene were added. This mixture was stirred for about two hours until the lumps were dissolved. During this step, the material cooled to an ambient temperature of approximately 80° F. At this stage, the liquid appeared roughly similar to a No. 6 fuel oil.

A 5.5 gallon batch of liquid catalyst was prepared by mixing 1.5 pounds of ammonium chloride, 1.5 pounds of ammonium nitrate, 0.8 fluid ounces of a 50% solution in water of sodium dodecylated oxydibenze disulfonate, and 0.025 pounds of alkylphenoxyl poly (ethylene oxy) ethanol with sufficient water to make 5.5 gallons. Glacial acetic acid (vinegar) and ammonia was added to adjust the pH to 7.5. 1 part of this liquid catalyst was mixed with 1,000 parts of a brine solution. An amount of brine/catalyst equal to the amount of heavy hydrocarbon material in the jar was added to the jar and stirred for about 15 seconds. This mixture was allowed to set for approximately one hour.

The liquid catalyst was drained off. The conversion product was poured into a quart container bottle and sent to a lab for analysis. Upon analysis, this conversion product produced results shown in column IB.

A portion of the conversion product was contacted by sonic vibrations in a sonic de-emulsifier at a frequency of 900 Hz producing the sample which upon analysis yielded the results shown in column IC.

An alternate operation was attempted with this vacuum tower bottoms. Here, the same procedure was followed as above except that 10 vol. % kerosene was used instead of the 5 vol. % above and the mixture of bottoms, kerosene, xylene, and d-limonene was not allowed to cool to ambient temperature, rather the temperature was maintained at 180°

F. After the liquid catalyst was drained off and the conversion product was contacted by sonic vibrations in a sonic de-emulsifier at a frequency of 900 Hz, a sample was sent to a lab for analysis. Upon analysis, this conversion product produced results shown in column ID.

Another alternate operation was attempted with this vacuum tower bottoms. Here, with conditions otherwise as above, the brine and catalyst solution was added contemporaneously with the d-limonene and solvents. This mixture was contacted with sonic vibrations of a frequency of 1400 to 1500 Hz in a sonic reactor. This operation yielded an unusable product due to the formation of a "gel". The gel is believed to have been formed due to the presence of surfactants in the liquid catalyst, which upon being contacted with sonic vibrations in the sonic reactor, caused a virtually unbreakable emulsion or gel. Thus, it is preferable not to allow any surfactants to flow through the sonic reactor.

TABLE I

| TEST | TEST METHOD | IA | IB | IC | ID |
|---|---|---|---|---|---|
| GRAVITY, API @60 F. | D-1298 | 8.0 | 16.4 | 15.2 | 13.0 |
| VISCOSITY KIN. cst. @ 122 DEG. F. | D-445 | NOTE 1 | 85.1 | 703.0 | 534.4 |
| POUR POINT DEG. C. | D-97 | 90 | <-33 | -6 | -12 |
| SULFUR, X-RAY, WT. % | D-4294 | 3.31 | 1.49 | 2.30 | 2.36 |
| ASH WT. % | D-482 | 0.14 | 0.13 | 0.08 | 0.18 |
| WATER BY DISTILLATION VOL. % | D-95 | NOTE 2 | 36.0 | 2.40 | 0.2 |
| SEDIMENT BY EXTRACTION WT. % | D-473 | 0.19 | 0.30 | 0.13 | 0.8 |
| ASPHALTENES WT. % | IP-143 | 17.0 | 8.80 | 11.49 | |
| CALORIFIC VALUE (GROSS) Btu/lb. | D-240 | 17,495 | 12,049 | 17,700 | 17,700 |
| TOTAL CHLORIDES WT. % | D-4929 | NOTE 3 | 0.44 | | |
| SALT CONTENT lb./1000 bbls. | D-3230 | | | 13.5 | |
| METALS ppm/wt. | NOTE 4 | | | | |
| IRON | | 6 | 2 | <1 | N/T |
| CHROMIUM | | <1 | 2 | 1 | N/T |
| NICKEL | | 81 | 24 | 16 | N/T |
| ALUMINUM | | 7 | 7 | 5 | N/T |
| LEAD | | <1 | 2 | <1 | N/T |
| COPPER | | <1 | <1 | <1 | N/T |
| TIN | | 4 | <1 | <1 | N/T |
| SILVER | | <.1 | 0.1 | <.1 | N/T |
| TITANIUM | | 2 | <1 | <1 | N/T |
| SILICON | | 2 | 1 | <1 | N/T |
| BORON | | <1 | <1 | <1 | N/T |
| SODIUM | | 2 | 51 | 18 | N/T |
| POTASSIUM | | <10 | <10 | 19 | N/T |
| MOLYBDENUM | | <5 | <5 | <5 | N/T |
| PHOSPHORUS | | 18 | <10 | <10 | N/T |
| ZINC | | <1 | <1 | <1 | N/T |
| CALCIUM | | <10 | 20 | <10 | N/T |
| BARIUM | | <10 | <10 | <10 | N/T |
| MAGNESIUM | | 4 | 2 | <1 | N/T |
| ANTIMONY | | 14 | <1 | <1 | N/T |
| VANADIUM | | 651 | 110 | 80 | N/T |
| SIMULATED DISTILLATION OF CRUDE | ASTM D-5307 | | | | |
| % OFF | | Deg. F. | Deg. F. | Deg. F. | |
| IBP | | 375 | 273 | 272 | 230 |
| 5 | | 943 | 280 | 343 | 278 |
| 10 | | — | 284 | 460 | 282 |
| 15 | | — | 292 | 535 | 289 |
| 20 | | — | 326 | 610 | 324 |
| 25 | | — | 344 | 683 | 343 |
| 30 | | — | 348 | 761 | 347 |
| 35 | | — | 355 | 834 | 350 |
| 40 | | — | 410 | 904 | 366 |
| 45 | | — | 915 | 973 | 436 |
| 50 | | — | — | — | 939 |
| 55 | | — | — | — | — |
| 60 | | — | — | — | — |
| 65 | | — | — | — | — |
| 70 | | — | — | — | — |
| 75 | | — | — | — | — |
| 80 | | — | — | — | — |
| 85 | | — | — | — | — |
| 90 | | — | — | — | — |
| 95 | | — | — | — | — |
| % Recovered @ 1000 Deg. F. | | 7.5 | 46.7 | 53.2 | 51.4 |
| % Residue | | 92.5 | 53.3 | 46.8 | 48.6 |

TABLE I-continued

| TEST | TEST METHOD | IA | IB | IC | ID |
|---|---|---|---|---|---|

NOTE 1: SAMPLE WAS SOLID AT 122 DEG. F.
NOTE 2: SAMPLE WOULD NOT RUN ACCORDING TO TEST PROCEDURE
NOTE 3: SAMPLE WOULD NOT RUN ACCORDING TO TEST PROCEDURE
NOTE 4: STANDARD SPECTROCHEMICAL (FAS 2C)
(N/T-NO TEST RESULTS, I.E., TEST WAS NOT REQUESTED)

The conversion of heavy hydrocarbon feed to lighter hydrocarbon product via the present process is clearly shown by the comparison of column IA with column IC or ID. As shown in column IA, 7.5 vol. % of the vacuum tower bottoms boiled off at temperatures below 1000° F. In the process which resulted in the lighter hydrocarbon product of column IC, only 13 vol. % of lighter material, i.e., 5 vol. % kerosene, 5 vol. % xylene and 3 vol. % d-limonene, were added However, the lighter hydrocarbon product shown in Column IC, had 53.2 vol. % boiled off at temperatures below 1000° F. Thus, the conversion of the heavy hydrocarbon feed of column IA to the lighter hydrocarbon product of column IC may be calculated as follows:

$$53.2 \text{ vol. \%} - (7.5 \text{ vol. \%} + 13 \text{ vol. \%}) = 32.7 \text{ vol. \%}$$

Likewise, in the process which resulted in the lighter hydrocarbon product shown in column ID, only 18 vol. % of lighter material, i.e., 10 vol. % kerosene, 5 vol. % xylene and 3 vol. % d-limonene, were added. However, the lighter hydrocarbon product shown in column ID had 51.4 vol. % boiled off at temperatures below 1000° F. Thus, the conversion of the heavy hydrocarbon feed of column IA to the lighter hydrocarbon product of column ID may be calculated as follows:

$$51.4 \text{ vol \%} - (7.5 \text{ vol \%} + 18 \text{ vol \%}) = 25.9 \text{ vol. \%}$$

The addition of 5% more kerosene did not improve the conversion of the heavy hydrocarbon feed into lighter boiling fractions. In fact, the efficiency of conversion dropped. It is believed that there is a threshold limit beyond which adding a specific solvent does not improve the efficiency of conversion. At that point, the process becomes a more conventional blending process. It should be noted however that the addition of 5 vol. % kerosene did significantly shift the distribution of the distillation curve toward the lighter end fractions. Therefore, it is likely, according to the believed theory, that the breaking of hydrocarbon bonds is still taking place.

A significant improvement was obtained in the metal content as seen by comparing IC to IA. Also, a significant reduction in the sulfur was achieved.

EXAMPLE II

In looking at a second example of the process, two products were created from a product thought to be the bottoms from an atmospheric distillation tower. This material would not qualify as a fuel oil because of its high viscosity. This material was sent to a lab for testing and is shown in Table II under column IIA.

Table IIA shows a product distribution for generic refinery product cuts. In Table IIA, the following boiling point ranges define the product cut offs.

| Product | Boiling Point |
|---|---|
| Naphtha | Below 347° F. |
| Kerosene | 347° F. to 527° F. |
| Gas-Oil | 527° F. to 1000° F. |
| Residue | above 1000° F. |

This feedstock (column IIA) was processed by heating the feedstock to 130° F. Then the material was mixed with 5% by vol. kerosene, 5% by vol. VM&P naphtha and 1.66% by vol. d-limonene. After a short period of mixing, approximately 45 seconds, the blended mixture was exposed to sonic vibration in a sonic reactor at 1430 Hz with a power-input of 50 W. The mixture was sonified for one minute. At this point, the mixture became very homogeneous.

The new substance was mixed with a brine/catalyst system for 30 seconds. The emulsified product was exposed in a de-emulsifier to sonic vibrations at a frequency of 900 Hz. The water phase was pulled off and the converted sample was sent to the lab for analysis. The results are shown in column IIB of Table II and Table IIA.

Converted sample IIC was produced in exactly the same sequence as IIB except only 0.66% by vol. d-limonene was used. These results are shown in Table II and Table IIA as column IIC.

Both kerosene and VM&P naphtha (light naphtha) are aliphatic solvents; no aromatic solvent was used in this example. As shown in column IIB and IIC of Table IIA, the pick-up in both the naphtha cut and the kerosene cut exceed the amount of these materials added during the process. Converted sample IIB and IIC are both high quality number 6 fuel oils. Sample IIB is a slightly better fuel oil because of its lower pour point and viscosity and its higher API. The extra 1% by vol. d-limonene used to make product IIB reduced the residual content by 2.7% more than in product IIC.

The liquid catalyst/brine system reduced the vanadium content (and presumably all metals) in the converted samples by 18% to 20%, the sulfur content was reduced by 15% to 18%.

TABLE II

| TEST | TEST METHOD | IIA | IIB | IIC |
|---|---|---|---|---|
| GRAVITY, API @60 F. | D-1298 | 10.1 | 15.0 | 14.6 |
| VISCOSITY KIN. cst. @122 DEG. F. | D-445 | 2144 | 189.6 | 232.7 |
| POUR POINT DEG. C. | D-97 | 6 | −27 | −24 |
| SULFUR, X-RAY, WT. % | D-4294 | 3.38 | 2.86 | 2.78 |
| ASH WT. % | D-482 | 0.11 | 0.87 | 0.092 |
| WATER BY DISTILLATION VOL. % | D-95 | 0.4 | 1.7 | 1.8 |
| SEDIMENT BY EXTRACTION WT. % | D-473 | 0.1 | 0.1 | 0.2 |
| CALORIFIC VALUE (GROSS) Btu/lb. | D-240 | 17,628 | 17,832 | 16,872 |
| VANADIUM ppm/wt. | NOTE 1 | 596 | 475 | 492 |
| SIMULATED DISTILLATION OF CRUDE | ASTM D-5307 | | | |
| % OFF | | Deg. F. | Deg. F. | Deg. F. |
| IBP | | 475 | 238 | 239 |
| 5 | | 554 | 310 | 295 |
| 10 | | 685 | 346 | 367 |
| 15 | | 740 | 413 | 450 |
| 20 | | 792 | 504 | 541 |
| 25 | | 843 | 588 | 624 |
| 30 | | 897 | 661 | 693 |
| 35 | | 955 | 725 | 757 |
| 40 | | — | 787 | 817 |
| 45 | | — | 846 | 879 |
| 50 | | — | 911 | 947 |
| 55 | | — | 981 | — |
| 60 | | — | — | — |
| 65 | | — | — | — |
| 70 | | — | — | — |
| 75 | | — | — | — |
| 80 | — | — | — | |
| 85 | | — | — | — |
| 90 | | — | — | — |
| 95 | | — | — | — |
| % Recovered @ 1000 Deg. F. | | 48.5 | 56.3 | 53.6 |
| % Residue | | 51.5 | 43.7 | 46.4 |

NOTE 1: SOL/DIL

TABLE IIA

| CUT | Refinery Cuts % By Volume Sample IIA | IIB | IIC |
|---|---|---|---|
| Naphtha | 0 | 10% | 8.5% |
| Kerosene | 0 | 12.5% | 11.5% |
| Gas-Oil | 48.5% | 33.8% | 33.6% |
| Residual | 51.5% | 43.7% | 46.4% |

EXAMPLE III

Feedstock material IIIA is known to be the bottoms from a vacuum tower operating in Texas City, Tex. The refiner confirmed that this material has little or no economic value. It is extremely difficult to store and transport. A lab analysis of this material is shown in Table III column IIIA and the product distribution in Table IIIA column IIIA. Both converted samples IIIB and IIIC were treated identically except xylene, an aromatic solvent, was used in IIIC in place of VM&P naphtha, an aliphatic solvent, in IIIB. The boiling point of xylene is 291° F. and falls in the naphtha cut boiling range.

Material IIIA was converted to product IIIB via the following steps:

1. Feedstock IIIA was heated to 180° F.
2. 5% by vol. kerosene, 5% by vol. VM&P naphtha, and 1.66% by vol. d-limonene was stirred in.
3. The stirring lasted 45 seconds to one minute.
4. The mixture was sonified for one minute at 1430 Hz and 50 W.
5. The mixture was not emulsified with the liquid catalyst/brine system.
6. The converted sample was sent to the lab for analysis.

Material IIIA was converted to IIIC in the exact same sequence except 5% by vol. xylene replaced the 5% by vol. naphtha. The results are tabulated in Table III and Table IIIA.

Substantial improvements were obtained in pour point, viscosity and API. The combination of d-limonene and xylene converted a slightly larger fraction of the residual and gas-oil fraction into lighter boiling material. Oil trading professionals confirmed a value of $8.50/bbl for product IIIC. It was classified as a blending stock for fuel oils.

TABLE III

| TEST | TEST METHOD | IIIA | IIIB | IIIC |
|---|---|---|---|---|
| GRAVITY, API @60 F. | D-1298 | 6.7 | 10.2 | 9.3 |
| VISCOSITY KIN. cst. @122 DEG. F. | D-445 | Note 1 | 8858 | 3503 |
| POUR POINT DEG. C. | D-97 | 66 | 21 | 18 |
| SULFUR, X-RAY, WT. % | D-4294 | 3.67 | N/T | 3.17 |
| ASH WT. % | D-482 | 0.043 | N/T | 0.042 |
| WATER BY DISTILLATION VOL. % | D-95 | 0.10 | N/T | N/T |
| SEDIMENT BY EXTRACTION WT. % | D-473 | 0.04 | N/T | 0.05 |
| ASPHALTENES WT. % | IP-143 | 6.68 | N/T | 6.42 |
| CALORIFIC VALUE (GROSS) Btu/lb. | D-240 | 17,764 | 17,934 | 17,888 |
| TOTAL CHLORIDES WT. % | D-4929 | 414 | N/T | 297 |
| METALS ppm/wt. | NOTE 2 | | | |
| IRON | | 29 | N/T | 25 |
| CHROMIUM | | <1 | N/T | 2 |
| NICKEL | | 26 | N/T | 27 |
| ALUMINUM | | 2 | N/T | 2 |
| LEAD | | <1 | N/T | 2 |
| COPPER | | <1 | N/T | <1 |
| TIN | | <1 | N/T | <1 |
| SILVER | | <.1 | N/T | <.1 |
| TITANIUM | | <1 | N/T | <1 |
| SILICON | | 4 | N/T | 2 |
| BORON | | <1 | N/T | <1 |
| SODIUM | | <1 | N/T | <1 |
| POTASSIUM | | 12 | N/T | 15 |
| MOLYBDENUM | | <5 | N/T | <5 |
| PHOSPHORUS | | <10 | N/T | <10 |
| ZINC | | 2 | N/T | <1 |
| CALCIUM | | <10 | N/T | <10 |
| BARIUM | | <10 | N/T | <10 |
| MAGNESIUM | | <1 | N/T | <1 |
| ANTIMONY | | 17 | N/T | <1 |
| VANADIUM | | 65 | N/T | 51 |
| SIMULATED DISTILLATION OF CRUDE | ASTM D-5307 | | | |
| % OFF | | Deg. F. | Deg. F. | Deg. F. |
| IBP | | 748 | 237 | 273 |
| 5 | | 949 | 339 | 312 |
| 10 | | — | 375 | 343 |
| 15 | | — | 892 | 761 |
| 20 | | — | 1001 | 971 |
| 25 | | — | — | — |
| 30 | | — | — | — |
| 35 | | — | — | — |
| 40 | | — | — | — |
| 45 | | — | — | — |
| 50 | | — | — | — |
| 55 | | — | — | — |
| 60 | | — | — | — |
| 65 | | — | — | — |
| 70 | | — | — | — |
| 75 | | — | — | — |
| 80 | | — | — | — |
| 85 | | — | — | — |
| 90 | | — | — | — |
| 95 | | — | — | — |
| % Recovered @ 1000 Deg. F. | | 8.3 | 19.9 | 21.7 |
| % Residue | | 91.7 | 80.1 | 78.3 |

NOTE 1 THE VISCOSITY AT 210° F. WAS 2653. THE SAMPLE WAS SOLID AT 122° F.
NOTE 2: STANDARD SPECTROCHEMICAL (FAS 2C)
(N/T-NO TEST RESULTS, I.E., TEST WAS NOT REQUESTED)

TABLE IIIA

| CUT | Refinery Cuts % By Volume Sample IIIA | IIIB | IIIC |
|---|---|---|---|
| Naphtha | 0 | 6.1% | 10% |
| Kerosene | 0 | 4.65% | 5% |
| Gas-Oil | 8.3% | 9.14% | 6.7% |
| Residual | 91.7% | 80.10% | 78.3% |

Example IV

A feedstock sample was prepared by blending the bottoms from a Fina solvent deasphalting unit (SDA) in Port Arthur, Tex. with an API 40 gravity crude. The blend was 35% by volume crude. To this was added 15% by volume kerosene. The straight blend was not exposed to the sonics and d-limonene was not added. Despite the addition of 50% by volume of lighter hydrocarbons, the blend had a viscosity of 80 cst at 212° F. This is above the specification of 50 cst at 212° F. for #6 fuel oil.

To correct the viscosity deficiency, 1.5% of a blended additive was added to the mixture and this combination was exposed to sonics. The additive blend was 30% d-limonene, 35% pine oil and 35% alpha-pinene (a terpene compound). The viscosity was reduced to 56 cst at 212° F.

A second sample was prepared whereby the Fina bottoms were mixed with 55% by volume crude oil, the viscosity measured 66 cst at 212° F. To this second sample was added a 1% by volume additive blend different from the previous example. This blend was comprised of 15% d-limonene, 17.5% pine oil, 17.5% alpha-pinene and 50% fatty acid ester. When the mixture was exposed to sonics, the end product measured 32 cst at 212° F. This example gives an indication of the effectiveness of the additive blends.

There are several general observations which may be made from the four examples. In all four examples, the heavy feedstock was converted to a lighter hydrocarbon product. It is not necessary to get a dramatic conversion of residual into lighter fractions to see a substantial economic gain. The additives are sufficient by themselves to improve the API, the pour point and the viscosity of the final product. The key ingredient is d-limonene. (It is believed that other terpenes will perform similarly.) Significant reductions in metal and sulfur can be achieved with the use of the liquid catalyst/brine solution. It is likely that each feedstock will have a unique combination of additives that optimizes results. The amount of additives is important for creating a refinery feedstock, a fuel oil, or a blending stock. Economics control how far the conversion should be taken. The four examples are included for illustrative purposes. The process has not been optimized in the examples.

The present inventive process is advantageous over known processes for the conversion of heavy hydrocarbon feeds to lighter hydrocarbon products as it provides a high conversion rate with minimum facilities and equipment and with mild operating conditions, i.e., low temperature and low pressure.

Figure 4:
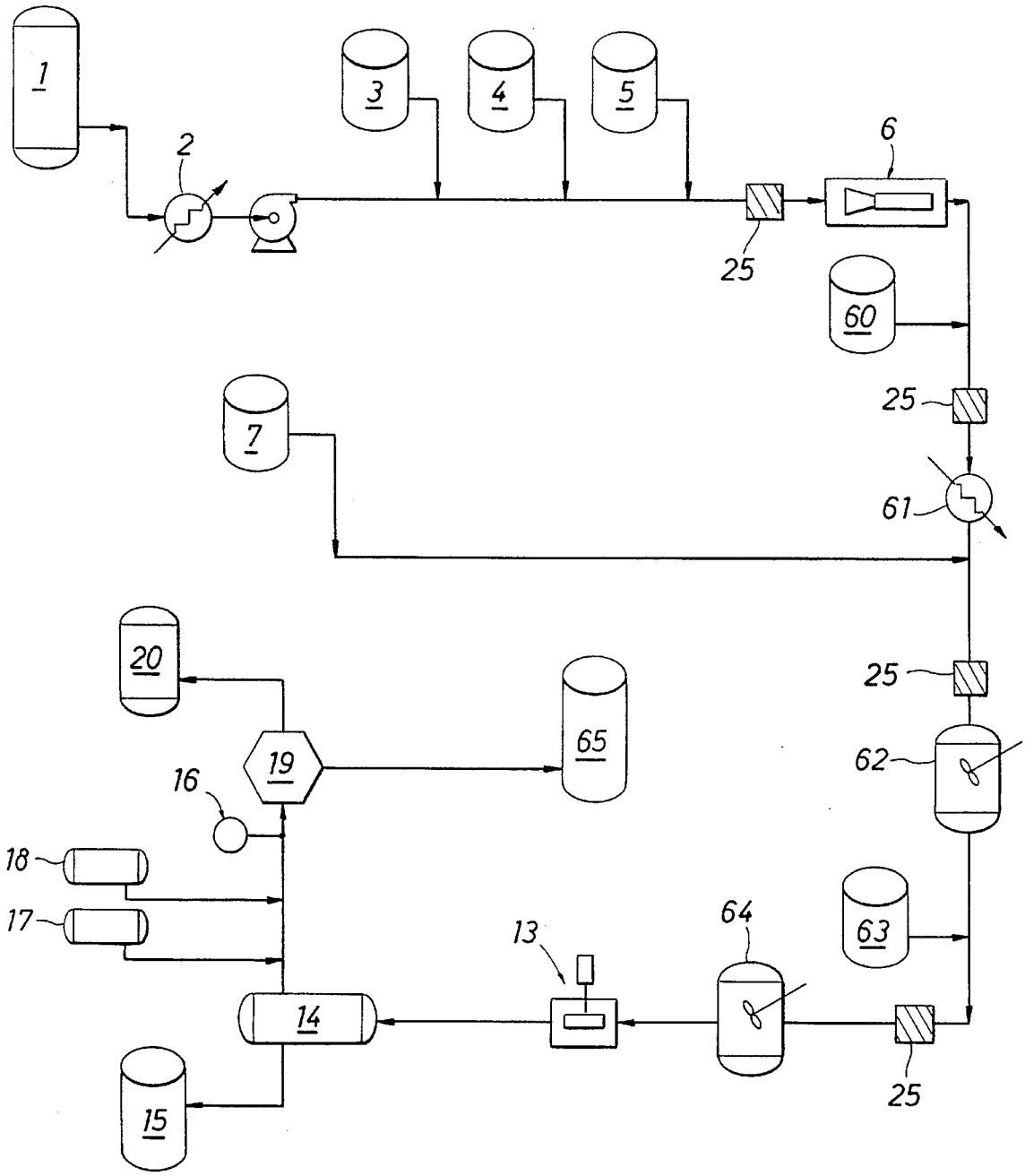
FIG. 4 is a simplified drawing showing an alternative process modified to reflect a liquid catalyst different from that used in FIG. 1.

FIG. 4 shows an alternative process that illustrates an alternate method for removing metals and sulfur from the heavy hydrocarbon feedstock and reflects a liquid catalyst different from that used with reference to the FIG. 1 embodiment. As compared with the FIG. 1 embodiment, this embodiment has several similar components and processing steps which are reflected in the same reference numbers being used as in the FIG. 1 embodiment. A thorough discussion of these similar components and processing steps is discussed above.

In this embodiment, the heavy hydrocarbon feed 1 passes through heat exchanger 2, if needed, and the various solvents and additives 3, 4 and 5 are added. The blended mixture passes through the sonic reactor 6. After sonification, water 60 is added. Approximately 20% by volume of water 60 is added for each barrel of the stream from the sonic reactor 6. The water and hydrocarbon mixture is heated to about 160° F. in heater 61. At this point, liquid catalyst 7 is added to the flow stream. Liquid catalyst 7 is a combination made up of by weight about 0 to about 5% ammonia sulfate, about 10 to about 20% ethylene glycol, about 10 to about 70% hydroxy acid and 5 to about 70% water. The preferred combination is about 3 to about 5% ammonia sulfate, about 12 to about 16% ethylene glycol, about 30 to about 50% hydroxy acid, and about 30 to about 50% water. The most preferred combination is about 4% ammonia sulfate, about 14% ethylene glycol, about 41% hydroxy acid and about 41% water.

Liquid catalyst 7 is added at the treatment rate of about 1% by volume to the water and hydrocarbon stream. Citric acid and hydroxy acetic acid are potent complexing agents and are the preferred choice for the hydroxy acid.

The catalyst, water and hydrocarbon mixture is sent to a stirred tank reactor 62. While the residence time may be any time suitable for the desired metals removal, it is preferred to have at least one hour of residence time in stirred tank reactor 62. Longer residence times may be employed depending on the quantity of metals reduction desired. Then, a chemical de-emulsifier 63 is added to promote the separation of hydrocarbon and water. While any suitable de-emulsifier may be used, it was found that Nalco 938210 was a suitable de-emulsifier when used at a treatment rate of about 1% by volume. The de-emulsifier 63 and the hydrocarbon and water mixture are stirred for about 5 minutes in stirred tank reactor 64. The stream from stirred tank 64 is sent to the sonic de-emulsifier 13. An oil/water separator 14 produces a lighter hydrocarbon product 15 and an aqueous phase. The aqueous phase is routed to pH meter 16 which controls the pH to a predetermined pH by the addition of acid 17 or base 18 to aid in the removal of solid particles in a solids separator 19. The solids are removed to a solids disposition 20 and the aqueous phase is sent to a water treatment plant 65. Example V shows the unexpectedly good results.

Example V

In this example with an alternate liquid catalyst, only used motor oil was employed as the heavy hydrocarbon feedstock. The primary objective was to remove the metals and to reduce the sulfur. No d-limonene nor solvent of any type was added in this example.

In general, the d-limonene, terpene or mixture of terpenes, and the solvents would be used if the heavy hydrocarbon was a resid or fuel oil. The more viscous feedstocks should be thinned considerably to promote the metals reduction process.

The liquid catalyst 7 combination described immediately above was used to treat a 200 ml sample of used motor oil. The motor oil contained 1300 ppm calcium, 1100 ppm zinc and 4800 ppm sulfur. 40 ml of water was added to the oil, and the mixture heated to 160° F. Hydroxy acetic acid was used as the hydroxy acid. An about 4 wt. % ammonia sulfate, about 14 wt. % ethylene glycol, about 41 wt. % hydroxy acetic acid and about 41 wt. % water solution of liquid catalyst 7 was formulated for this experiment. 2.4 ml of the liquid catalyst 7 was added to the oil water mixture. The mixture was stirred for one hour at an average temperature of 150° F. After the one hour mixing, 1.6 ml of Nalco 938210 de-emulsifying chemical was added. The new mixture was stirred for 6 minutes. The liquid was centrifuged for 10 minutes to effectuate oil and water separation. A metals test on the product oil showed calcium at 405 ppm, zinc at 242 ppm and sulfur at 3923 ppm. Thus, there was a 68.8% reduction in calcium, 78% reduction in zinc and a 18.3% reduction in sulfur.

A second test was performed with citric acid as the hydroxy acid. This test was larger in scale. This test used 1600 ml of another used motor oil and 320 ml $H_2O$. The temperature was maintained at about 175° F. 20 ml of liquid catalyst 7 was added and the blend was stirred for about 60 minutes. Next, 10 ml of Nalco's 938210 de-emulsifier was added and stirred for 15 minutes. A liquid sample was withdrawn and centrifuged to effectuate the separation of the oil and water. The product oil measured 201 ppm calcium, 200 ppm zinc, and 3864 ppm sulfur. The original motor oil tested 1319 ppm calcium, 1002 ppm zinc, and 4941 ppm sulfur. Adding the calcium and zinc together relates to an initial metals content of 2321 ppm and an ending metal content of 401 ppm or an 82.7% reduction in metals.

A third test was performed switching back to hydroxy acetic acid. However, an elevated temperature of 170° F. was used. The test was conducted with 200 ml of oil and 40 ml of water. 2.4 ml of liquid catalyst 7 was added and the mixture stirred for 90 minutes at an average temperature of 170° F. Then, 2 ml of de-emulsifying chemical was added and the mixture stirred for 7 minutes. A sample was withdrawn and centrifuged for 10 minutes. In the product oil, the calcium content dropped from 1265 ppm to 110 ppm (a 91% reduction), zinc dropped from 1003 to 191 ppm (a 80.1% reduction), and sulfur dropped from 4550 to 3904 ppm (a 14.2% reduction). Metals and ash are directly related and the ash dropped from 0.8% to 0.106%%.

Ash is the sediment created when an oil, e.g., motor oil, is burned in a combustion chamber. The typical burn temperature is not high enough to volatize the metals. Therefore, the metals form a substantial percentage of the residue left when all the volatile material has been consumed. Since used motor oil is often burned as a fuel, a high ash content means that the motor oil will leave behind a substantial amount of residue. This ash must be removed on a periodic basis. Ash removal can be a significant operational cost. Disposal is also a problem. Low ash content motor oils sell at a premium price within the fuel oil markets.

Removing the metals from other heavy hydrocarbon feedstocks is important to creating a low ash fuel oil. Removing the metals is also an important step in creating a refinery feedstock that will not poison or deactivate the typical catalyst beds found in refinery processing steps.

These three tests confirm the ability of this liquid catalyst 7 to facilitate removal of metals from the hydrocarbon feed. In addition to the components of the liquid catalyst 7, stirring time and temperature are important factors in the quantity of metals removed.

Although the invention has been described with reference to its preferred embodiments, those of skill in the art may from this description appreciate changes and modifications which can be made therein which do not depart from the scope and spirit of the invention as described and claimed hereafter.

What is claimed is:

1. In a process for the conversion of a heavy hydrocarbon feed to a lighter hydrocarbon product, the heavy hydrocarbon feed having a volume, of zero or more, boiling off at temperatures below 1000° F., the improvement comprising the steps of:

adding a terpene to the heavy hydrocarbon feed, the terpene having a volume boiling off at temperatures below 1000° F.; and reacting the heavy hydrocarbon feed and the terpene to form a lighter hydrocarbon product, the lighter hydrocarbon product having a greater volume boiling off at temperatures below 1000° F. than a combination of the heavy hydrocarbon feed volume boiling off at temperatures below 1000° F. and the terpene volume boiling off at temperatures below 1000° F.

2. The process of claim 1, wherein the terpene is d-limonene.

3. A process for conversion of a heavy hydrocarbon feed to a lighter hydrocarbon product, comprising the steps of:

obtaining a heavy hydrocarbon feed;

adding d-limonene;

adding a liquid catalyst, the liquid catalyst comprising in an aqueous solution, a free chloride ion source, a free nitrate ion source and an anionic hydrophile;

reacting the heavy hydrocarbon feed, the d-limonene and the liquid catalyst to form a lighter hydrocarbon product and an aqueous phase, the lighter hydrocarbon product having a lower viscosity and a lower density than the heavy hydrocarbon feed; and separating the aqueous phase from the lighter hydrocarbon product.

4. The process of claim 3, wherein the free chloride ion source is selected from the group consisting of ammonium chloride, hydrogen chloride, lithium chloride, potassium chloride and sodium chloride.

5. The process of claim 3, wherein the nitrate ion source is selected from the group consisting of ammonium nitrate, nitric acid, lithium nitrate, potassium nitrate and sodium nitrate.

6. The process of claim 3, further comprising the step of:

adding a brine solution.

7. The process of claim 6, further comprising the step of:

prior to adding the liquid catalyst, adding an aromatic solvent and an aliphatic solvent sufficient to reduce the viscosity of the heavy hydrocarbon feed to a flowable state at a temperature of about ambient temperature to 200° F.

8. The process of claim 7, further comprising the step of:

prior to adding the liquid catalyst, contacting with sonic vibrations, in combination, the heavy hydrocarbon feed, the d-limonene, the aromatic solvent, and the aliphatic solvent.

9. The process of claim 8, wherein the sonic vibrations are of variable frequency within a frequency range effective to effectuate the breaking of hydrocarbon bonds.

10. The process of claim 9, wherein the frequency range is from 1000 Hz to 2000 Hz.

11. The process of claim 9, wherein the frequency range is about 1430 Hz.

12. The process of claim 8, further comprising the step of adding an ammonium ion source selected from the group consisting of ammonia gas and ammonium hydroxide.

13. The process of claim 3, wherein the d-limonene is added in an amount of about 0.5 vol. % to about 50 vol. %.

14. The process of claim 3, wherein the d-limonene is added in an amount of about 0.5 vol. % to about 10 vol. %.

15. The process of claim 3, wherein a sonic de-emulsifier is used in the step of separating the aqueous phase from the lighter hydrocarbon product.

16. A process for conversion of a heavy hydrocarbon feed to a lighter hydrocarbon product, comprising the steps of:

obtaining a heavy hydrocarbon feed, the heavy hydrocarbon feed having a volume, of zero or more, boiling off at temperatures below 1000° F;

reacting the heavy hydrocarbon feed with about 0.5 vol. % to about 50 vol. % d-limonene, the d-limonene having a volume boiling off at temperatures below 1000° F.;

thereafter, adding a liquid catalyst and brine solution, to form a lighter hydrocarbon product and an aqueous phase, the liquid catalyst and brine solution comprising in an aqueous solution, a free chloride ion source, a free nitrate ion source and an anionic hydrophile, separating the lighter hydrocarbon product and the aqueous phase; and wherein, the lighter hydrocarbon product has a greater volume boiling off at temperatures below 1000° F. than a combination of the heavy hydrocarbon feed volume boiling off at temperatures below 1000° F. and the d-limonene volume boiling off at temperatures below 1000° F.

17. The process of claim 16 wherein the free chloride ion source is selected from the group consisting of ammonium chloride, hydrogen chloride, lithium chloride, potassium chloride and sodium chloride.

18. The process of claim 16, wherein the nitrate ion source is selected from the group consisting of ammonium nitrate, nitric acid, lithium nitrate, potassium nitrate and sodium nitrate.

19. The process of claim 16, further comprising the step of:

prior to adding the liquid catalyst and brine solution, adding an aromatic solvent and an aliphatic solvent sufficient to reduce the viscosity of the heavy hydrocarbon feed to a flowable state at a temperature of about ambient temperature to 200° F.

20. The process of claim 19, further comprising the step of:

prior to adding the liquid catalyst and brine solution, contacting with sonic vibrations, in combination, the heavy hydrocarbon feed, the d-limonene, the aromatic solvent, and the aliphatic solvent.

21. The process of claim 20, wherein the sonic vibrations are of variable frequency within a frequency range effective to effectuate the breaking of hydrocarbon bonds.

22. The process of claim 21, wherein the frequency range is from 1000 Hz to 2000 Hz.

23. The process of claim 21, wherein the frequency range is about 1430 Hz.

24. The process of claim 16, further comprising the step of adding an ammonium ion source selected from the group consisting of ammonia gas and ammonium hydroxide.

25. The process of claim 16, wherein the heavy hydrocarbon feed is reacted with about 0.5 vol. % to about 10 vol. % d-limonene.

26. The process of claim 19, wherein the aliphatic solvent is selected from the group consisting of kerosene and VM&P naphtha.

27. The process of claim 26, wherein the kerosene is added in an amount of about 1 vol. % to about 15 vol. %.

28. The process of claim 16, wherein a sonic de-emulsifier is used in the step of separating the aqueous phase from the lighter hydrocarbon product.

29. The process of claim 19, wherein the aromatic solvent is xylene.

30. In a process for the conversion of a heavy hydrocarbon feed to a lighter hydrocarbon product, the heavy hydrocarbon feed having a volume, of zero or more, boiling off at temperatures below 1000° F., the improvement comprising the steps of:

adding a mixture comprising at least one terpene, pine oil and a fatty acid ester to the heavy hydrocarbon feed, the mixture having a volume boiling off at temperatures below 1000° F.; and reacting the heavy hydrocarbon feed and the mixture to form a lighter hydrocarbon product, the lighter hydrocarbon product having a greater volume boiling off at temperatures below 1000° F. than a combination of the heavy hydrocarbon feed volume boiling off at temperatures below 1000° F. and the mixture volume boiling off at temperatures below 1000° F.

* * * * *